US012006791B2

(12) United States Patent
Alssamen

(10) Patent No.: US 12,006,791 B2
(45) Date of Patent: Jun. 11, 2024

(54) METHODS AND SYSTEMS FOR A SUBSURFACE SAFETY VALVE OPENING SLEEVE TOOL

(71) Applicant: SAUDI ARABIAN OIL COMPANY, Dhahran (SA)

(72) Inventor: Hussain Ali Alssamen, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/810,231

(22) Filed: Jun. 30, 2022

(65) Prior Publication Data

US 2024/0003224 A1 Jan. 4, 2024

(51) Int. Cl.

| | |
|---|---|
| ***E21B 34/14*** | (2006.01) |
| ***E21B 33/06*** | (2006.01) |
| ***E21B 33/072*** | (2006.01) |

(52) U.S. Cl.

CPC ..... *E21B 34/14* (2013.01); *E21B 33/06* (2013.01); *E21B 2200/06* (2020.05)

(58) Field of Classification Search

CPC ..... E21B 34/142; E21B 34/12; E21B 34/14; E21B 23/14; E21B 2200/05; E21B 34/02; E21B 34/105; E21B 33/06; E21B 33/072; E21B 33/068

See application file for complete search history.

(56) References Cited

U.S. PATENT DOCUMENTS

| | | | | |
|---|---|---|---|---|
| 3,066,693 | A * | 12/1962 | Taylor, Jr. | E21B 34/10 137/454.2 |
| 3,318,387 | A * | 5/1967 | Jones | E21B 21/10 166/325 |
| 6,991,040 | B2 * | 1/2006 | Hill, Jr. | E21B 34/14 166/373 |
| 8,042,617 | B2 * | 10/2011 | Bowles | E21B 19/08 166/241.5 |
| 10,030,482 | B2 * | 7/2018 | Leggett | E21B 33/03 |
| 10,066,462 | B1 * | 9/2018 | Sawyer | E21B 34/02 |
| 10,502,027 | B2 * | 12/2019 | Horwell | E21B 34/102 |
| 11,434,713 | B2 * | 9/2022 | Eitschberger | E21B 23/08 |
| 11,459,852 | B2 * | 10/2022 | Taha | E21B 34/063 |
| 2008/0277122 | A1 * | 11/2008 | Tinnen | E21B 23/14 166/339 |
| 2012/0152564 | A1 * | 6/2012 | Peltier | E21B 34/02 166/373 |
| 2015/0260010 | A1 * | 9/2015 | Lugtmeier | E21B 33/03 166/97.1 |
| 2016/0145970 | A1 * | 5/2016 | Armistead | E21B 34/14 166/373 |

* cited by examiner

*Primary Examiner* — Kenneth L Thompson

(74) *Attorney, Agent, or Firm* — Osha Bergman Watanabe & Burton LLP

(57) ABSTRACT

A method for a well intervention operation may be conducted on a wellbore having a subsurface safety valve in a tubular string therein with a wireline extending into the wellbore from a wellhead. The method may include deploying an opening sleeve tool into the wellbore; landing a top portion of the opening sleeve tool on the subsurface safety valve; forcing a gate valve of the subsurface safety valve with a tubular portion of the opening sleeve tool from a closed position to an open position; and conducting the well intervention operation.

8 Claims, 9 Drawing Sheets

METHODS AND SYSTEMS FOR A SUBSURFACE SAFETY VALVE OPENING SLEEVE TOOL

BACKGROUND

In the oil and gas industry, operations may be performed in a wellbore at various depths below the surface with downhole tools. A subsurface safety valve (SSSV) may be installed in the upper wellbore, below the wellhead, to provide emergency closure of the producing conduits in the event of an emergency. the SSSV is designed to be fail-safe, so that the wellbore is isolated in the event of any system failure or damage to the surface production-control facilities. For example, the SSSV may be used as a primary isolation barrier for hydrocarbon production and may also be used as an isolation barrier when installing components in or performing maintenance on the wellhead.

The downhole tools may require maintenance/repair or replacement, or become stuck, even when preventive measures are taken. Well intervention operations are conducted for removing (i.e., pulling out-of-hole (POH)) downhole tools from the wellbore. A wireline, slickline, or coiled tubing may be sent into the wellbore to retrieve the downhole tools. In some cases, when attempting to POH, a gate of the SSSV may be closed against the wireline, slickline, or coiled tubing. The gate may take a long period of time to get it released. However, if the SSSV fails to release the tools, conventional methods require cutting the wireline, slickline, or coiled tubing downhole, retrieve the SSSV, fish out the tools and the reset the SSSV. In such an event, non-productive time (NPT) may increase in addition to possible equipment damage, hazardous work environment, and total well lose.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a method for a well intervention operation on a wellbore having a subsurface safety valve in a tubular string therein with a wireline extending into the wellbore from a wellhead. The method may include deploying an opening sleeve tool into the wellbore; landing a top portion of the opening sleeve tool on the subsurface safety valve; forcing a gate valve of the subsurface safety valve with a tubular portion of the opening sleeve tool from a closed position to an open position; and conducting the well intervention operation.

In another aspect, the embodiments disclosed herein relate to an opening sleeve tool. The opening sleeve tool may include a top portion having a first outer diameter, the top portion includes a fish neck; and a tubular portion defining a bore extending downward a length from the top portion. The first outer diameter may be larger than a second outer diameter of the tubular portion. Additionally, an end of the tubular portion distal to the top portion may be configured to engage a gate valve.

In yet another aspect, the embodiments disclosed herein relate to a system. The system may include a wellhead on a surface of a wellbore, a blowout preventer is disposed on top of the wellhead; a tubing string disposed within the wellbore; a cable extending downward into the wellbore from the blowout preventer and the wellhead, the cable is connected to a bottomhole assembly within the wellbore; a subsurface safety valve disposed in the tubing string; and an opening sleeve tool attached to the cable. The opening sleeve tool may include a top portion configured to land on an upper most end of the subsurface safety valve; and a tubular portion defining a bore extending downward a length from the top portion. An end of the tubular portion distal to the top portion is configured to force a gate valve of the subsurface safety valve to move from a closed position to an open position.

Other aspects and advantages will be apparent from the following description and the appended claims.

BRIEF DESCRIPTION OF DRAWINGS

Embodiments of the present disclosure will now be described in detail with reference to the accompanying Figures. Like elements in the various Figures may be denoted by like reference numerals for consistency.

DETAILED DESCRIPTION

Figure 1:
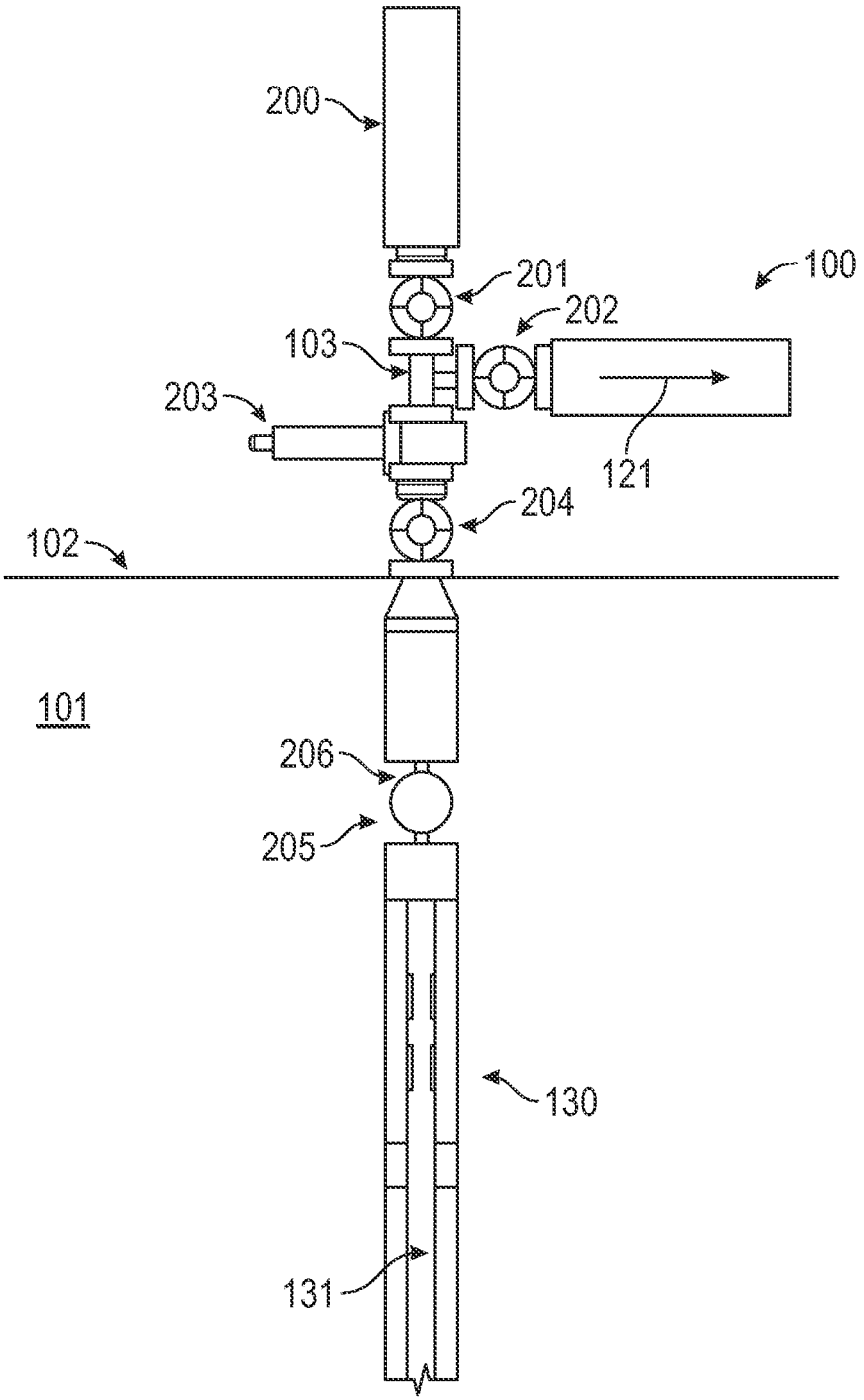
FIG. 1 illustrates a well system in accordance with one or more embodiments.

In the following detailed description of embodiments of the present disclosure, numerous specific details are set forth to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" "attached" or "attached to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification. In addition, any terms designating tubular (i.e., a length of pipe that provides a conduit for flow therein) should not be deemed to limit the scope of the disclosure. The embodiments are described merely as examples of useful applications, which are not limited to any specific details of the embodiments herein.

Embodiments disclosed herein relate generally to well intervention operations in oil and gas well sites. More specifically, embodiments disclosed herein relate to systems and methods for using an opening sleeve tool to open a subsurface safety valve (SSSV) for retrieving downhole tools connected to a cable (e.g., wireline, slickline, or coiled tubing). In one aspect, embodiments disclosed herein pertain to when the SSSV fails to open, the opening sleeve tool is deployed to force open the SSSV to allow operations to continue, such as, pulling out safely through the failed SSSV.

FIG. 1 shows a block diagram of a well site 100 in accordance with one or more embodiments. The well site 100 includes a wellbore 130 in fluid communication with a hydrocarbon reservoir ("reservoir") located in a subsurface formation ("formation") 101. The formation 101 may include a porous formation that resides underground, beneath the Earth's surface 102. The formation 101 and the reservoir may include different layers of rock having varying characteristics, such as varying degrees of permeability, porosity, capillary pressure, and resistivity. In the case of the well site 100 being operated as a production well, the well site 100 may facilitate the extraction of hydrocarbons (or "production") from the reservoir.

The wellbore 130 may include a bored hole that extends from the surface 102 into a target zone of the formation 101, such as the reservoir. An upper end of the wellbore 130, terminating at or near the surface 102, may be referred to as the "up-hole" end of the wellbore 130, and a lower end of the wellbore 130, terminating in the formation, may be referred to as the "down-hole" end of the wellbore 130. The wellbore 130 may facilitate the circulation of drilling fluids during drilling operations, the flow of production 121 (e.g., hydrocarbons such as oil and gas) from the reservoir to the surface 102 during production operations, the injection of substances (e.g., water) into the formation 101 or the reservoir during injection operations, or the communication of monitoring devices (e.g., logging tools) into the formation 101 or the reservoir during monitoring operations (e.g., during in situ logging operations).

In some embodiments, the wellbore 130 may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In embodiments having a casing, the casing defines a central passage that provides a conduit for the transport of tools and substances through the wellbore 130. For example, the central passage may provide a conduit for lowering logging tools into the wellbore 130, a conduit for the flow of production (121) (e.g., oil and gas) from the reservoir to the surface 102, or a conduit for the flow of injection substances (e.g., water) from the surface 102 into the formation 101. In some embodiments, a tubular string, such as a production tubing 131, may be installed in the wellbore 130. The production tubing 131 may provide a conduit for the transport of tools and substances through the wellbore 130. The production tubing 131 may, for example, be disposed inside casing. In such an embodiment, the production tubing may provide a conduit for some or all of the production 121 (e.g., oil and gas) passing through the wellbore 130 and the casing.

In some embodiments, a wellhead 103 may include a rigid structure installed at the "up-hole" end of the wellbore 130, at or near where the wellbore 130 terminates at the Earth's surface 102. The wellhead 103 may include structures (called "wellhead casing hanger" for casing and "tubing hanger" for production tubing) for supporting (or "hanging") casing and production tubing extending into the wellbore 130. Production 121 may flow through the wellhead 130, after exiting the wellbore 130, including, for example, the casing and the production tubing 131. Additionally, a blowout preventer (BOP) 200 may be coupled on top of the wellhead 103. The BOP 200 is a valve or stacks of valves device, used to seal, control and monitor oil and gas wells to prevent blowouts, the uncontrolled release of crude oil or natural gas from the wellbore 130. Further, the BOP 200, or a well cap in the case where no BOP provided on the wellhead 103, provides access to wellbore 130 for interventions with a wireline, slickline, or coil tubing.

Still referring to FIG. 1, various flow regulating devices are operable to control the flow of substances into and out of the wellbore 130. For example, the wellhead 103 may include a crown valve 201, a wing valve 202, a surface safety valve 203, a master valve 204, and a subsurface safety valve (SSSV) 205. The crown valve 201 is the upper most valve within the wellhead 103. Typically, the crown valve 201 is closed until there is a need to access the wellbore 130. The wing valve 202 is for production flow control. In the case of needing to enter the wellbore 130, the wing valve 202 would be closed and the master valve 204 would be open. The surface safety valve 203 is typically a hydraulic failsafe close valve located at surface. The surface safety valve 203 may be used in the event of an issue in the wellbore/surface equipment and for testing. The master valve (204) is the main valve controlling flow from the wellbore 130.

In one or more embodiments, the SSSV 205 is another safety device located below the surface 102, e.g., several hundred plus feet below the surface 102. The SSSV 205 makes up part of the production tubing 131 and is a means for safety close in the case of uncontrolled release of hydrocarbons, such as a kick. Also, the SSSV 205 may be used as a barrier when testing or is needed to perform maintenance on the wellhead 130. It is further envisioned that the SSSV 205 may land on a ported nipple sub 206 of the production tubing 131. The ported nipple sub 206 incorporates a reduced diameter internal profile for the SSSV 205 to land on and prevents the SSSV 205 from passing through the ported nipple sub 206. Additionally, the ported nipple sub 206 may include an inlet for a hydraulic line to attach to and provide power to the SSSV 205 from the surface 108. For example, the inlet of the ported nipple sub 206 is fluid communication with a hydraulic oil system at the surface 108.

Figure 2A:
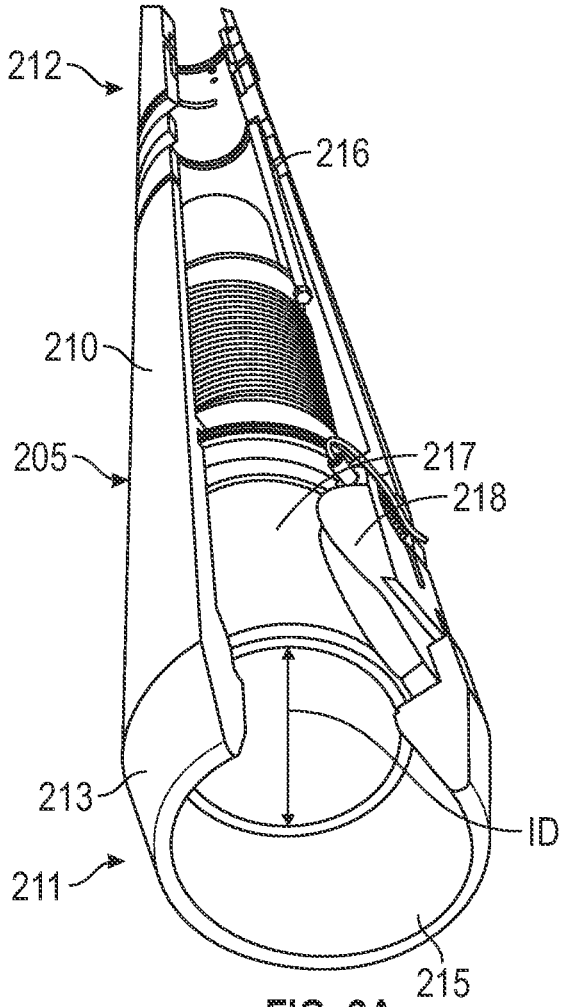
FIGS. 2A and 2B illustrate a cross-sectional view of a subsurface safety valve in accordance with one or more embodiments.
Figure 2B:
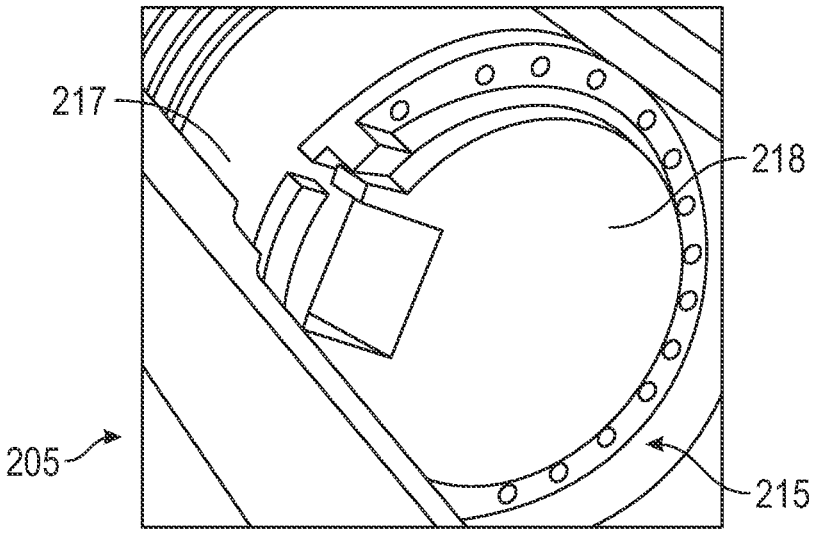

Now referring to FIGS. 2A and 2B, a cross-section view of the SSSV 205 is illustrated. The SSSV 205 is shown in an open position in FIG. 2A and in a closed position in FIG. 2B. The SSSV 205 includes a body 210 axially extending from a first end 211 to a second end 212. The body 210 defines a bore 215 that provides a conduit for downhole tools and for fluids to pass through. The first end 211 may be a lower end which is positioned downward in the wellbore.

Additionally, the first end 211 may include a sloped surface 213 to land on the ported nipple sub. The second end 212 may be an upper end which is positioned upward in the wellbore. Further, the second end 212 may be fish neck of the SSSV 205.

In one or more embodiments, as shown in FIG. 2A, the SSSV 205 includes various internal components to conduct operations. For example, a hydraulic pressure system provides power to the SSSV 205 to axially move an actuation device 217 to open and close a gate valve 218. The hydraulic pressure system includes a hydraulic line 216 which receives power from the hydraulic oil system at the surface via the inlet of the ported nipple sub. The hydraulic line 216 applies hydraulic pressure and moves the actuation device 217, such as a piston, downward to push the gate valve 218 into the open position, as shown in FIG. 2A. Additionally, an inner diameter ID of the actuation device 217 may be equal to a nominal inner diameter of the SSSV 205 which limits the size of downhole tools able to pass through the SSSV 205. With the gate valve 218 in the open position, access to the wellbore is allowed to conduct various downhole operations such as well intervention.

As shown in FIG. 2B, if the hydraulic pressure system fails and does not provide power to the SSSV 205, the actuation device 217 will move axially upward and allow the gate valve 218 to move the closed position. In the closed position, the gate valve 218 closes the bore 215 thereby blocking access to the wellbore. In the closed position, the SSSV 205 prevents downhole operations from being conducted which may increase NPT, damage equipment, make the work environment hazardous, or cause a total well loss. In some embodiments, if the gate valve 218 closes during a well intervention operation, the downhole tools, such as a bottomhole assembly (BHA), cannot be pulled out-of-hole (POH) and the wireline, slickline, or coiled tubing must be cut resulting in loss of equipment (e.g., the downhole tools) downhole or having to conduct fishing operations.

In the case that the hydraulic pressure system fails, to prevent the gate valve 218 from being in the closed position blocking downhole operations, an opening sleeve tool, as described below, is deployed to force open the gate valve 218 of the SSSV 205 to allow operations to continue.

Figure 3:
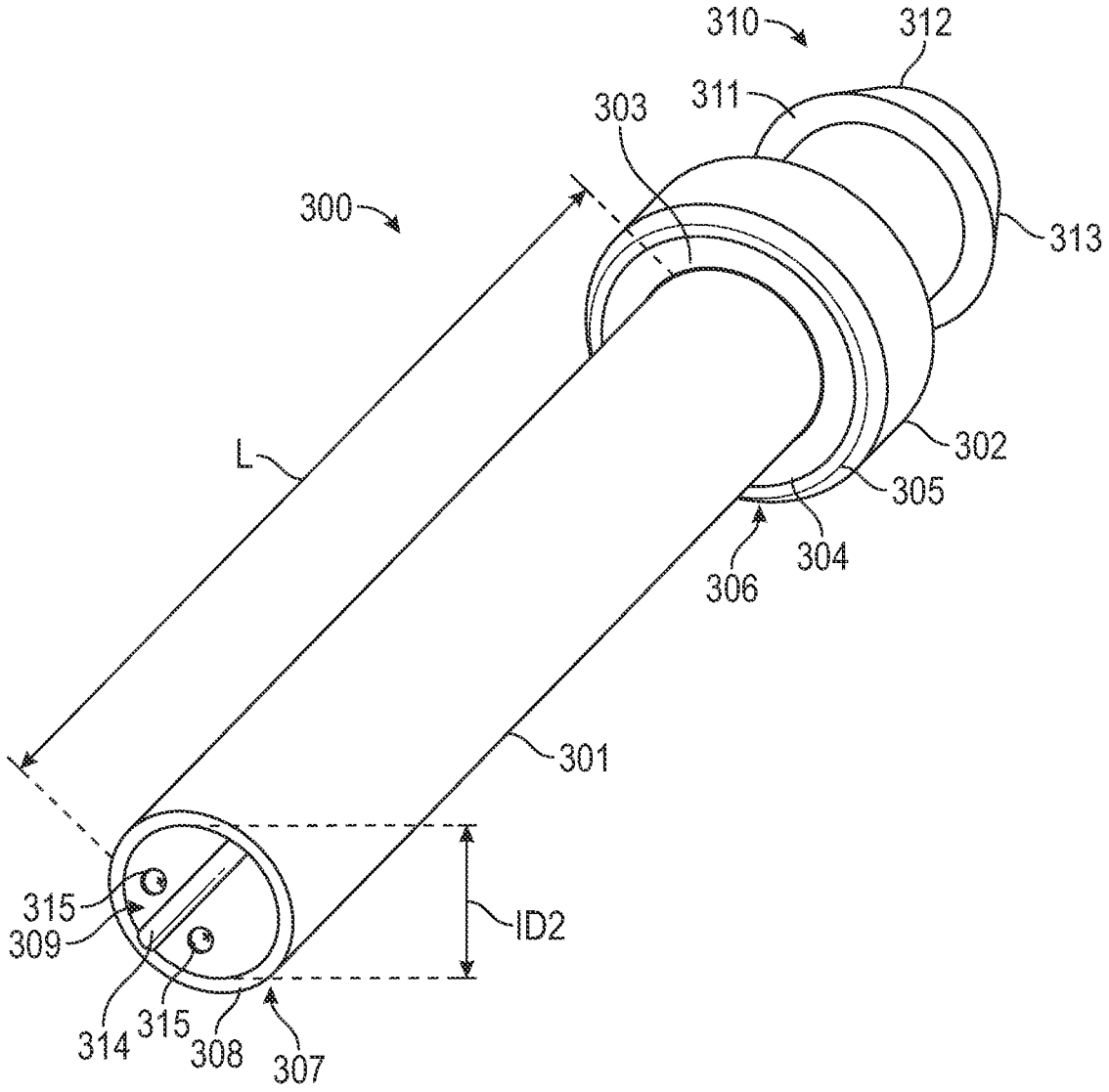
FIG. 3 illustrates a perspective view of an opening sleeve tool in accordance with one or more embodiments.

Referring to FIG. 3, in one or more embodiments, an opening sleeve tool 300 is illustrated. The opening sleeve tool 300 includes a tubular portion 301 and a top portion 302. When deployed, the top portion 302 lands on top of the SSSV (205). For example, a bottom surface 303 of the top portion 302 lands on the upper most end, such as the fish neck, of the SSSV (205). The top portion 302 also acts as a no-go device to prevent the opening sleeve tool 300 from failing through the SSSV (205). The top portion 302 has an outer diameter that is larger than an outer diameter of the tubular portion 301 to from the no-go device. Additionally, in one or more embodiments, the bottom surface 303 may include a lip or groove 304 to engage the upper most end of the SSSV (205). Further, a seal 305, such as an elastomer seal or may be provided in the lip or groove 304 to provides a seal between the opening sleeve tool 300 and the SSSV (205).

In one or more embodiments, the top portion 302 includes a fish neck 310. The fish neck 310 includes a bottom end 311 and a top end 312. The bottom end 311 may have a larger diameter than the top end 312 such that there is a tapered surface 313 from the bottom end 311 to the top end 312. Both the bottom end 311 and the top end 312 may include openings. The openings of the bottom end 311 and the top end 312 may allow for a cable to run through the fish neck 310; however, the tapered surface 313 prevents downhole tools from traveling upward through the opening of the top end 312. For example, downhole tools may be pulled upward through the opening of the bottom end 311 and engage the tapered surface 313 to be stopped from exiting out of the opening of the top end 312. With the downhole tool engaged in the fish neck 310, both the downhole tool and the opening sleeve tool 300 may be retrieved to the surface.

In some embodiments, the tubular portion 301 of the opening sleeve tool 300 extends axially a length L from a first end 306 to a second end 307. The first end 306 is attached to the bottom surface 303 of the top portion 302 such that the second end 307 extends downward distal from the top portion 302. The length L of the tubular portion 301 may be a length that allows the second end 307 to engage the gate valve (218) of the SSSV (205) when the top portion 302 lands on top of the SSSV (205). For example, the length L may have a value greater than the length of the SSSV (205) to ensure engagement of the tubular portion 301 with the gate valve (218). It is further envisioned that the tubular portion 301 is a rigid member made of a metal, such as steel, or a resilient material that can provide and within stand a force to push open the gate valve (218) of the SSSV (205). Additionally, the second end 307 may include an engagement surface 308 to contact the gate valve (218) of the SSSV (205). Further, the engagement surface 308 may include a rubber material or coating to prevent damage to the gate valve (218) of the SSSV (205).

Still referring to FIG. 3, the tubular portion 301 defines a bore 309 having an inner diameter ID2. The inner diameter ID2 has a maximum valve equal to the inner diameter (ID) of the actuation device (217) of the SSSV (205) and a minimum valve equal to largest outer diameter of a downhole tool that may pass through the SSSV (205). Additionally, the bore 309 has a first opening at the second end 307 and a second opening at the first end 306. The first opening allows downhole tools to be pulled into the opening sleeve tool 300 and the second opening allows the downhole tools to be pulled into contact with the fish neck 310. Further, the bore 309 may include a groove 314 to receive a cable. Additionally, set screws 315 may be used to engage and lock the cable within the opening sleeve tool 300.

Figure 4:
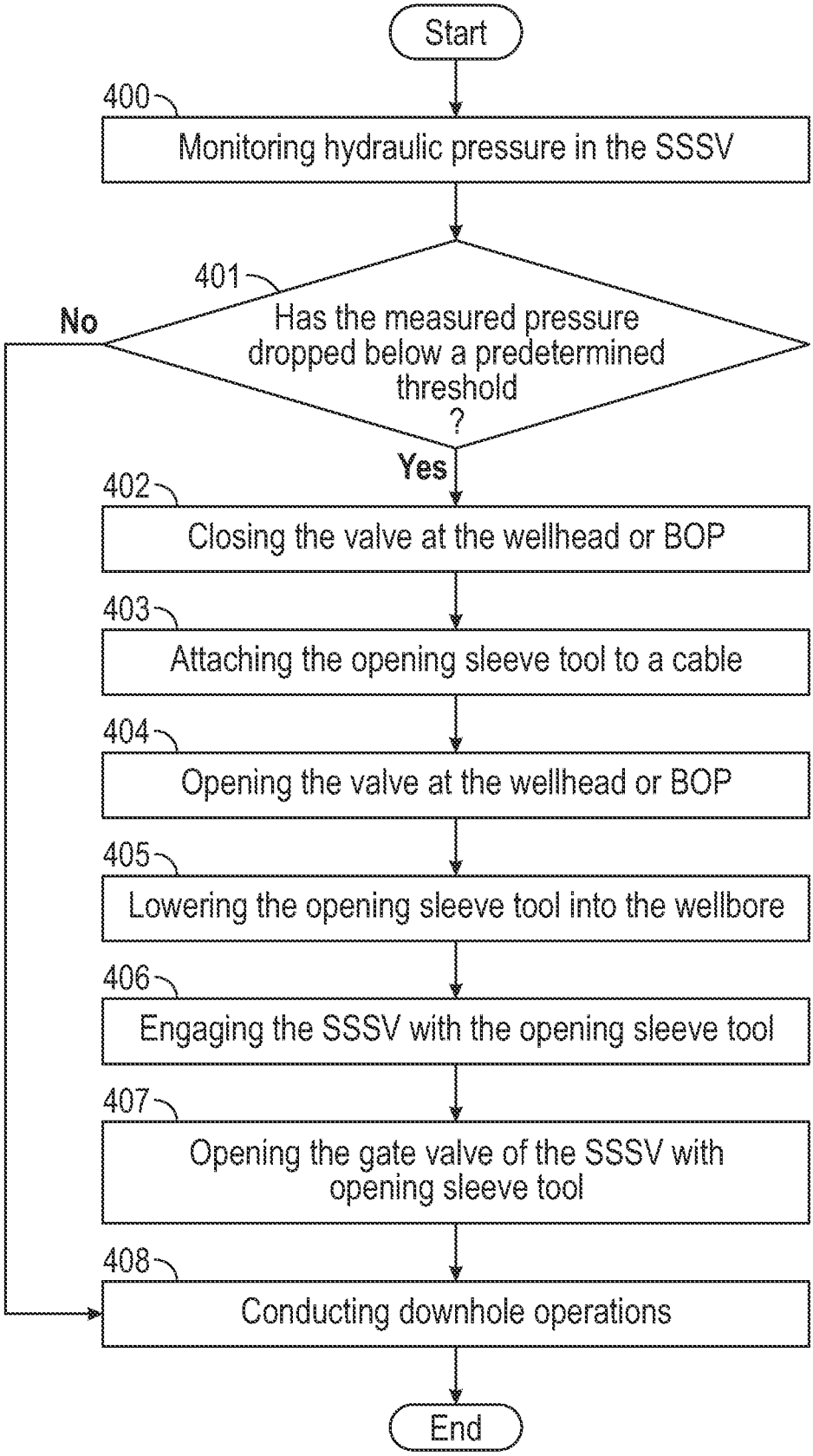
FIG. 4 illustrates a flowchart in accordance with one or more embodiments.

FIG. 4 is a flowchart showing a method of using the opening sleeve tool 300 of FIG. 3 at a well site (such as the well site described in FIG. 1). One or more blocks in FIG. 4 may be performed by one or more components (e.g., a computing system coupled to a controller in communication with the devices at the well site 100). For example, a non-transitory computer readable medium may store instructions on a memory coupled to a processor such that the instructions include functionality for deploying the opening sleeve tool 300. While the various blocks in FIG. 4 are presented and described sequentially, one of ordinary skill in the art will appreciate that some or all of the blocks may be executed in different orders, may be combined or omitted; and some or all of the blocks may be executed in parallel. Furthermore, the blocks may be performed actively or passively.

In Block 400, a hydraulic pressure to the SSSV is continuously monitored. For example, various pressure sensors positioned in the wellbore and on the surface may measure an amount of hydraulic pressure being provided to the SSSV. The various pressure sensors transmit the measurements to a controller and/or operator to be monitored.

In Block 401, the measured hydraulic pressure is compared to predetermined thresholds. For example, the predetermined threshold of the hydraulic pressure to the SSSV may be a value equal to a minimum amount of hydraulic pressure (for example, a required hydraulic pressure of 4,000-10,000 psi) required to keep the SSSV open (i.e., the actuation device is moved to a downward position to displace the gate valve to the open position). If the measured hydraulic pressure has not dropped below the predetermined threshold, this indicates that the SSSV is maintained in the open position, thereby allowing downhole operations to be conducted as shown in Block 408. However, if the measured hydraulic pressure has dropped below the predetermined threshold, this indicates that the SSSV has failed (i.e., the actuation device has moved upward no longer engaging the gate valve, and the gate valve is moved to the closed position). With the SSSV indicated as failed, the method moves to the Block 402.

In addition to or an alternative to Blocks 401 and 402, to determine if the SSSV indicated has failed, cables traveling through the SSSV may be pulled on to see if the cables can be moved upward. If the cables can be moved upward, then the SSSV has not failed as the gate valve must be opened for the cables to move upward. However, if the cables cannot be moved upwards but only move downward, this indicates that the SSSV has failed and the method moves to the Block 402.

In Block 402, with the SSSV indicated as failed, a valve at the wellhead or BOP is closed. If there is no BOP on top of the wellhead, the main valve of the wellhead is closed. If there is a BOP stacked on top of the wellhead, the valve of the BOP is closed. By closing the valve in the wellhead or the BOP, the wellbore is shutoff and allows surface operations to be conducted safely.

In Block 403, with the valve in the wellhead or the BOP closed, the opening sleeve tool is attached to a cable, such as a wireline, slickline, or coiled tubing, and run into the wellbore. For example, the opening sleeve tool is placed over an end of the cable outside the wellhead or the BOP such that the cable runs through the opening sleeve tool. Additionally, the cable is set within a groove of the opening sleeve tool and set screws lock the cable within the opening sleeve tool.

In Block 404, with the opening sleeve tool on the cable/wireline/tubing, the valve at the wellhead or BOP is opened to allow the opening sleeve tool to travel into the wellbore.

In Block 405, with the valve in the wellhead or the BOP opened, the opening sleeve tool is lowered into the wellbore. For example, the opening sleeve tool travels along a length of the cable to reach a predetermined depth in the wellbore. The predetermined depth is a depth at which the SSSV is disposed within the wellbore.

In Block 406, the opening sleeve tool engages with the SSSV. For example, the top portion of the opening sleeve tool lands on or directly contacts and sits on top of an upper end of the SSSV. In some embodiments, the bottom surface of the top portion sits on top of the fish neck of the SSSV. The lip or groove on the bottom surface may seal against a top surface of the fish neck.

In Block 407, with the opening sleeve tool landed on the SSSV, the gate valve of the SSSV is opened by the opening sleeve tool via the downward force from dropping the opening sleeve tool. For example, an end of the tubular portion contacts the gate valve, and the tubular portion applies a downward force on the gate valve to move the gate valve to the open position. Additionally, to determine if the gate valve has been opened by the opening sleeve tool, the cable traveling through the SSSV is pulled upward; and if the cable is not restricted, the cable will be able to moved upward.

In Block 408, with the gate valve forcibly opened by the opening sleeve tool, downhole operations are conducted. For example, well intervention operations such as retrieval of trapped downhole tools are conducted (i.e., rescuing downhole tools by pulling up along with the opening sleeve tool). Specifically, the trapped downhole tools may be pulled upward, into the opening sleeve tool, and out of the wellbore for maintenance, repair, or replacement. Additionally, as the trapped downhole tools are pulled into the opening sleeve tool, the trapped downhole tools engage the fish neck of the opening sleeve tool. With the trapped downhole tools engaged with the fish neck, the opening sleeve tool is also pulled upward and out of the wellbore with the trapped downhole tools.

Now referring FIGS. 5-9, in one or more embodiments, FIGS. 5-9 illustrate a system of implementing the method described in the flowchart of FIG. 4 using the opening sleeve tool 300 of FIG. 3 in a well intervention operation.

Figure 5:
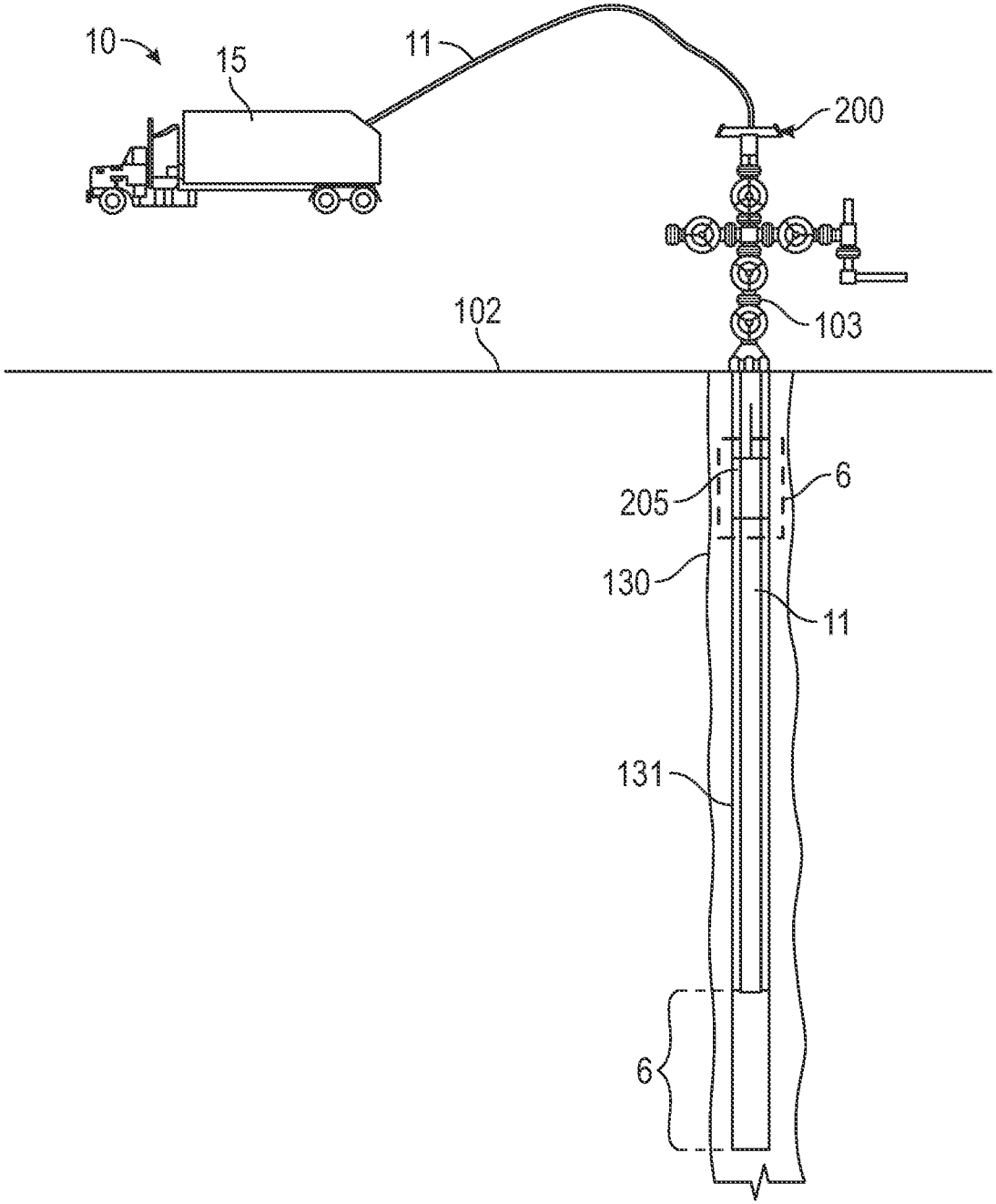
FIGS. 5-9 show examples of implementing the method of FIG. 4 using the opening sleeve tool of FIG. 3 in accordance with one or more embodiments of the present disclosure.

In FIG. 5, in one or more embodiments, a close-up view of the surface 102 of FIG. 1 is illustrated. In a well intervention operation, a cable 11 is employed from a cable unit 10 into the wellhead 103. The cable unit 10 may be a truck 15 or trailer having a drum to spool and unspool the wireline, slickline, or coiled tubing. The cable 11 may be inserted into the wellhead 103 via the BOP 200 rigged on top of the wellhead 103. The BOP 200 may include a blind ram to close and seal around the cable 11 which allows operations to be performed under pressure, on surface equipment, when the cable 11 is still in the wellbore 103. Then the valves of the wellhead 103 are opened to enable the cable 11 to fall or be pumped into the wellbore 130 under pressure.

From the wellhead 103, the cable 11 passes through the SSSV 205, down a tubular string, such as the production tubing 131, and connects down to a bottomhole assembly (BHA) 6. the BHA 6 may include various components such as drill bits, drill collars, mud motors, stabilizers, sensitive measurement equipment, logging while drilling (LWD) tools, measurement while drilling (MWD) tools, and various other downhole tools without departing from the scope of the present disclosure.

Figure 6:
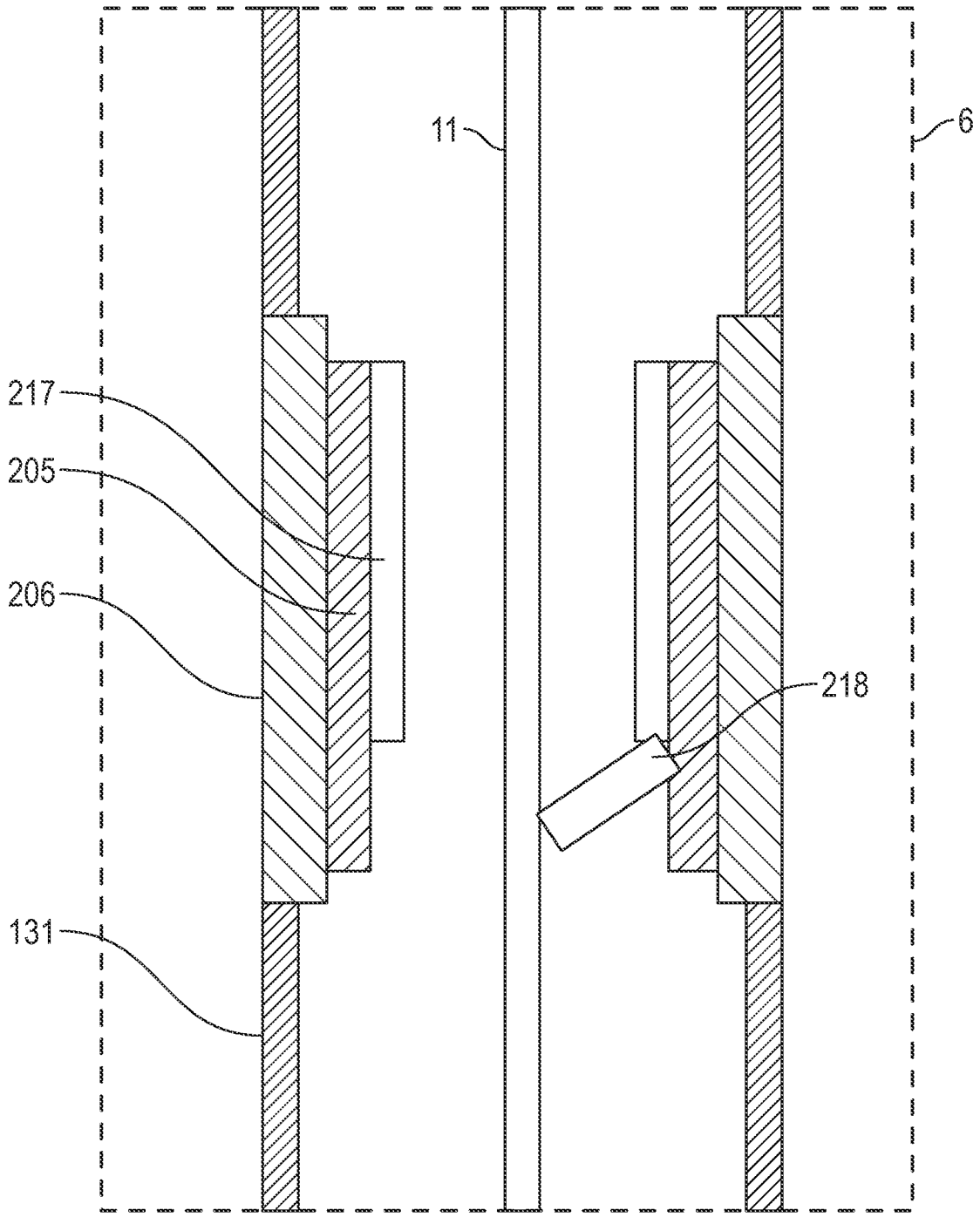

FIG. 6 illustrates a closeup cross-sectional view of the dotted box 6 of FIG. 5. As previously described, the SSSV 205 lands on the ported nipple sub 206 of the production tubing 131. In the case that the hydraulic pressure system fails, the hydraulic pressure within the SSSV 205 has dropped allowing the actuation device 217 to move axially upward and to move the gate valve 218 out of the open position. Without the gate valve 218 in the open position, the gate valve 218 encounters the wire 11.

Figure 7:
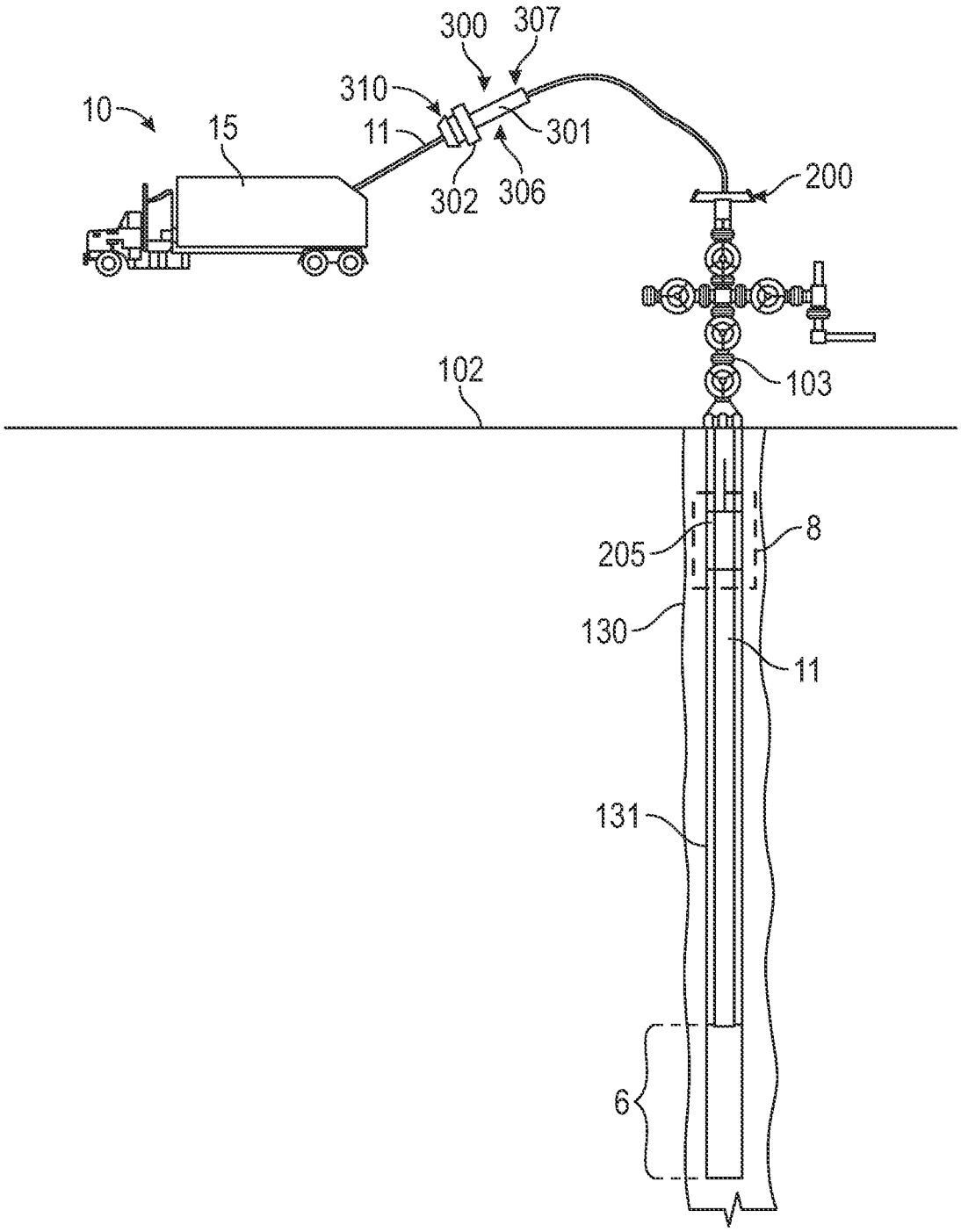

Now referring to FIG. 7, as the hydraulic pressure system failed, the opening sleeve tool 300 (as described in FIG. 3) is deployed to move the gate valve (218) back to the open position. The opening sleeve tool 300 is attached to the cable 11 on the surface 102. For example, the cable 11 is run through the first opening at the second end 307 so that the cable 11 travels through the bore (309) of the tubular portion 301, and past the second opening at the first end 306 to exit the opening sleeve tool 300 via the fish neck 310. Additionally, the cable 11 is set within the groove (314) that is defined in the bore (309). Further, set screws (315) lock the cable 11 within the groove (314). With the opening sleeve tool 300 on the cable 11, the BOP 200 is opened to allow the opening sleeve tool 300 to be lowered in the wellbore 130 and land SSSV 205. For example, the opening sleeve tool 300 simply dropped down the wellbore 130 to generate a force downward on the SSSV 205.

Figure 8:
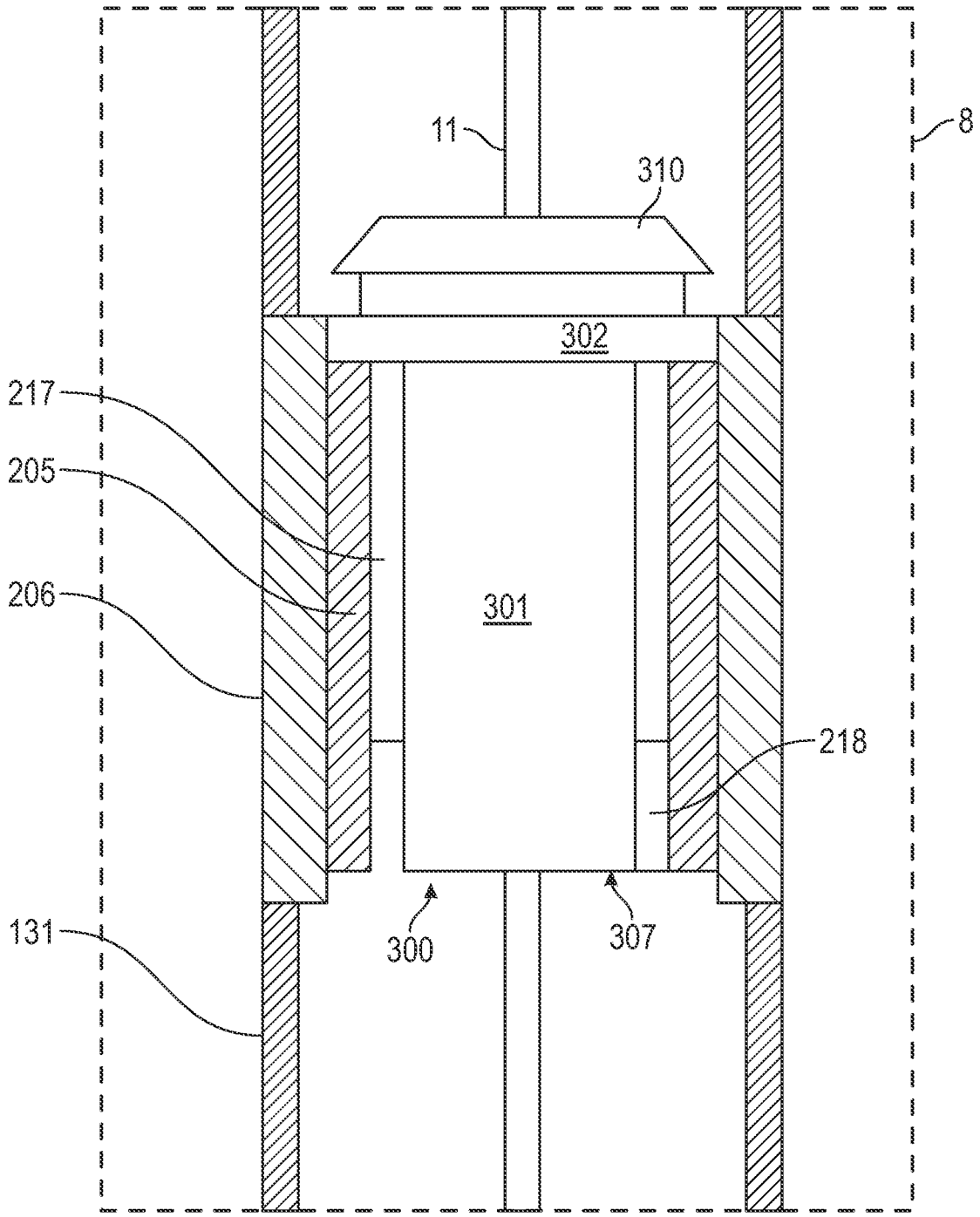

FIG. 8 illustrates a closeup cross-sectional view of the dotted box 8 of FIG. 7. As previously described, the opening sleeve tool 300 is deployed and lowered into the tubing string 121. The top portion 302 lands on the upper most surface of the SSSV 205. From the top portion 302, the tubular portion 301 extends downward such that the second end 307 forces that the gate valve 218 to the open position. With the gate valve 218 back in the open position, well intervention operations may continue.

Figure 9:
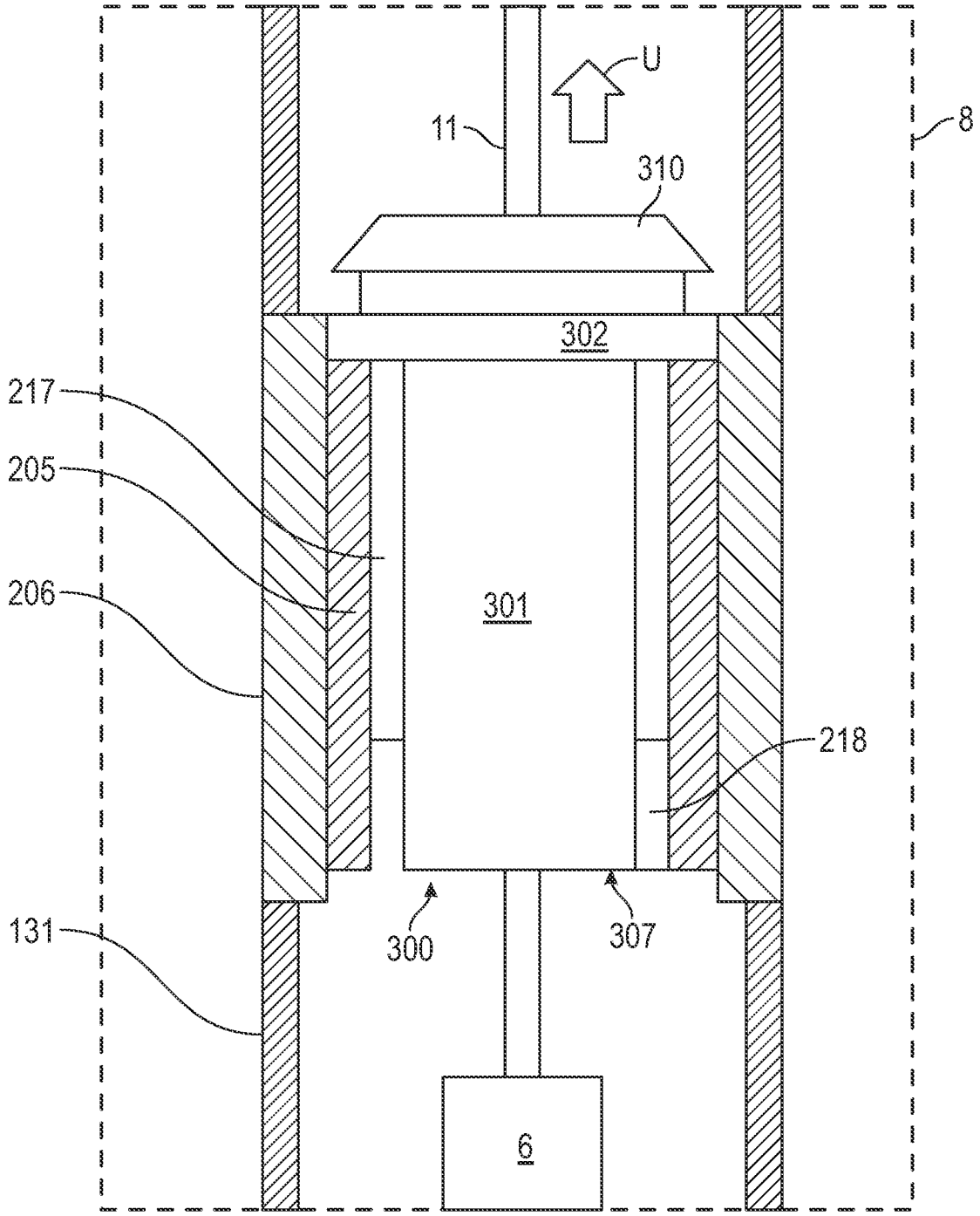

Now referring to FIG. 9, with the opening sleeve tool 300 landed on the SSSV 205 and moving the gate valve 218 to the open position, the cable 11 may be move upward (see block Arrow U) to retrieve the BHA 6 thereon. As the BHA 6 travels upward, the BHA 6 will pass through the bore (309) of the tubular portion 301 and engage the fish neck 310 of the opening sleeve tool 300. The BHA 6 and the opening sleeve tool 300 may be raised together to the surface (108)

for maintenance, repairs, or replacement. It is further envisioned that if the cable 11 has been cut, a pulling tool (not shown) may be deployed to latch onto the fish neck 310 to retrieve the opening sleeve tool 300.

In case of hydraulic failure, according to embodiments herein, a method and system for utilizing an opening sleeve tool is deployed to open a subsurface safety valve (SSSV). By using the opening sleeve tool, well control is achieved in the case where the SSSV fails. Additionally, using the opening sleeve tool according to embodiments herein avoids losing tools downhole and cutting the wireline, slickline, or coiled tubing. Overall, in the case where the SSSV fails, using the opening sleeve tool to open the SSSV may minimize the need for fishing operations and can return the well to service faster to significantly improve the operational safety, reliability, and longevity during drilling, completion, well intervention, and work-over operations.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A system, comprising:

a wellhead on a surface of a wellbore, wherein a blowout preventer is disposed on top of the wellhead;

a tubing string disposed within the wellbore;

a cable extending downward into the wellbore from the blowout preventer and the wellhead, wherein the cable is connected to a bottomhole assembly within the wellbore;

a subsurface safety valve disposed in the tubing string; and an opening sleeve tool attached to the cable, the opening sleeve tool comprising:

a top portion configured to land on an upper most end of the subsurface safety valve; and a tubular portion defining a bore extending downward a length from the top portion, wherein an end of the tubular portion distal to the top portion is configured to force a gate valve of the subsurface safety valve to move from a closed position to an open position; and wherein an inner diameter of the tubular portion is greater than an outer diameter of the bottomhole assembly.

2. The system of claim 1, wherein a bottom surface of the top portion comprises a lip or groove to engage a fish neck of the subsurface safety valve.

3. The system of claim 1, wherein the end of the tubular portion comprises an opening to access the wellbore.

4. The system of claim 3, wherein the end comprises an engagement surface to contact the gate valve.

5. The system of claim 1, wherein the top portion further comprises a fish neck configured to engage the bottomhole assembly.

6. The system of claim 1, wherein the tubular portion further comprises a groove to receive the cable.

7. The system of claim 6, wherein set screws lock the cable in the groove.

8. The system of claim 1, wherein the opening sleeve tool is configured to be lowered into the wellbore when the subsurface safety valve fails and the gate valve closes.

* * * * *